US007462074B1

(12) United States Patent
Devlin et al.

(10) Patent No.: US 7,462,074 B1
(45) Date of Patent: Dec. 9, 2008

(54) ROTATING PLUG ADAPTER WITH INTEGRAL TWO BLADE AND GROUNDING POST RECEPTACLE

(75) Inventors: Thomas E. Devlin, Somerville, MA (US); George Favaloro, Lincoln, MA (US)

(73) Assignee: Southwire Company, Carrollton, GA (US)

( * ) Notice: Subject to any disclaimer, the term of this patent is extended or adjusted under 35 U.S.C. 154(b) by 0 days.

(21) Appl. No.: 12/026,936

(22) Filed: Feb. 6, 2008

(51) Int. Cl.
*H01R 25/00* (2006.01)

(52) U.S. Cl. ..... 439/640; 439/22; 439/106

(58) Field of Classification Search ..... 439/101, 439/104, 638, 640, 11–30
See application file for complete search history.

(56) References Cited

U.S. PATENT DOCUMENTS

| | | | | |
|---|---|---|---|---|
| 2,687,515 | A * | 8/1954 | Booth | 439/27 |
| 5,775,921 | A | 7/1998 | Chou | |
| 5,954,519 | A | 9/1999 | Hsiao | |
| 5,997,310 | A | 12/1999 | Chiu et al. | |
| 6,089,921 | A | 7/2000 | Chou | |
| 6,302,743 | B1 | 10/2001 | Chiu et al. | |
| 6,332,794 | B1 | 12/2001 | Jeng | |
| 6,457,988 | B1 | 10/2002 | Andersen | |
| 6,638,074 | B1 * | 10/2003 | Fisher | 439/22 |
| 6,793,499 | B1 | 9/2004 | Chen | |
| 6,821,134 | B2 * | 11/2004 | Chen | 439/131 |
| 7,214,101 | B1 * | 5/2007 | Tong | 439/638 |
| 2006/0068608 | A1 * | 3/2006 | McFadden | 439/22 |

* cited by examiner

*Primary Examiner*—Briggitte R Hammond
(74) *Attorney, Agent, or Firm*—Smith, Gambrell & Russell

(57) ABSTRACT

A rotating two blade plug and grounding post adapter includes a housing including a top and bottom coupled to freely rotate about a rotary cap disposed between the housing top and bottom. Right and left electrical spades and a grounding post extend from the rotary cap and a receptacle integral to the periphery of the housing accepts a two blade and grounding plug that may be oriented at a wall receptacle by rotating the adapter housing and receptacle to a desired orientation. Internal flanges define grooves in which rotary electrical contacts are maintained through rotation of the housing and integral receptacle.

20 Claims, 5 Drawing Sheets

ROTATING PLUG ADAPTER WITH INTEGRAL TWO BLADE AND GROUNDING POST RECEPTACLE

BACKGROUND

The present invention relates to two blade and grounding post electrical plugs and adapters, i.e. three (3) prong adapters, and more particularly to rotating plug adapters. Conventional plug adapters and plugs typically extend in a one-way outward direction perpendicular to a wall receptacle. As a result, conventional plugs often obstruct the positioning of furniture, appliances and other items close to wall.

U.S. Pat. No. 5,775,921 to Chou teaches flat profile rotating electrical plugs suitable for narrow areas. Such plugs, however, require direct wiring to an electrical apparatus or appliance, and are therefore incompatible for enabling rotation of an existing plug at a wall receptacle. Similarly, known extension cords and power strips with rotating plugs require direct wiring to the plug that is plugged into the receptacle.

A need therefore exists for a rotating plug adapter with an integral receptacle that does not require direct wiring to an electrical appliance. Further there is a need for a rotating adapter enabling conventional plugs to be rotatably oriented directly at a wall receptacle without an additional extension cord or power strip wired to a plug.

SUMMARY

The present invention answers these needs by providing in one embodiment an electrical plug adapter comprising a housing including a top, bottom and outer periphery, a cap rotatably mounted between the top and bottom of the housing, a first spade mounted in the cap, wherein the first spade includes a first spade rotary contact rotatably abutting a first housing rotary contact, a second spade mounted in the cap, wherein the second spade includes a second spade rotary contact rotatably abutting a second housing rotary contact, a grounding post mounted in the cap, wherein the grounding post includes a grounding rotary contact rotatably abutting a housing grounding rotary contact, a plug receptacle integral to the outer periphery of the housing and rotatable around the rotary cap, wherein the plug receptacle includes a first receptacle opening including a portion of the first housing rotary contact mounted therein, a second receptacle opening including a portion of the second housing rotary contact mounted therein, and a grounding post receptacle opening including a portion of the housing grounding rotary contact mounted therein.

In one embodiment a rotary ratchet spring mounted between the top and bottom of the housing is provided to facilitate firm orientation of the integral plug receptacle once rotated to a desired position. In further embodiments, the rotary cap include a plurality of teeth and the ratchet spring includes one or more wings rotatable between a pair of teeth to lock the ratchet and housing with the plug receptacle facing a desired position. In further embodiments the rotary ratchet spring is integral to the housing grounding rotary contact.

In other embodiments of the invention the housing of a rotatable plug adapter is flat and low profile. In such embodiments it is an object of the invention to allow existing conventional plugs to be oriented at a desired rotatable position in the adapter while improving the fit over perpendicular insertion of conventional plugs into conventional wall receptacles that obstruct furniture, appliances and other items that may be placed close to the wall receptacle.

DETAILED DESCRIPTION

Embodiments of the invention will be described with reference to the accompanying drawings and figures wherein like numbers represent like elements throughout. Directional terms, such as left and right depend on one's point of view, and are intended to be non-limiting as such described components are reversible in alternative embodiments. Further, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. The terms "mounted", "connected", and "coupled" are used broadly and encompass both direct and indirect mounting, connecting and coupling. Further, "connected" and "coupled" are not restricted to physical or mechanical connections or couplings.

In one described embodiment, the invention provides a flat profile rotating plug adapter. It will be appreciated that other embodiments of the invention include rotating plug adapters with alternative sizes, shapes and profiles.

In one embodiment the invention provides electrical contacts that includes metal conductors with sufficient cross section to carry a rated load of 20 amps. In other embodiments the invention and corresponding structures may be scaled to carry greater loads.

Figure 1:
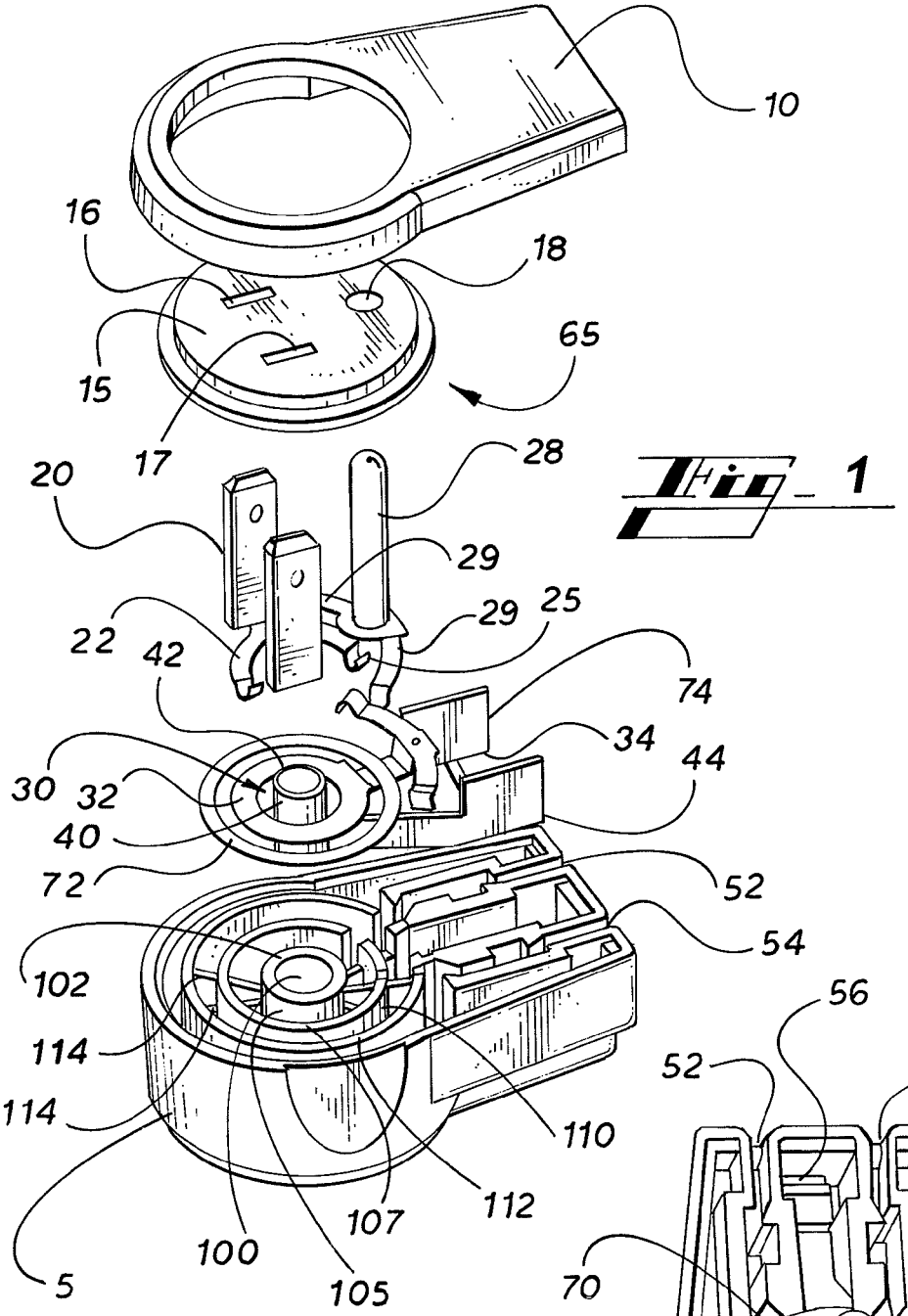
FIG. 1 is an exploded view of a plug adapter in an embodiment of the present invention.
Figure 2:
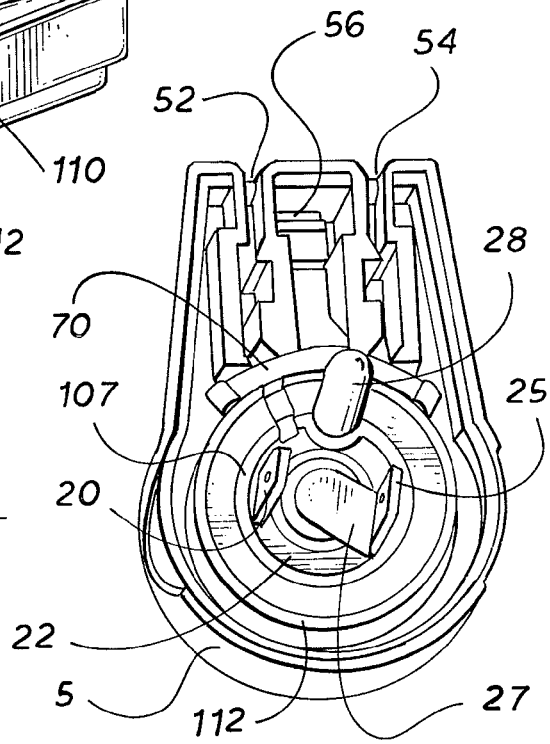
FIG. 2 is an internal perspective assembly view of a housing top in an embodiment of the present invention.
Figure 3:
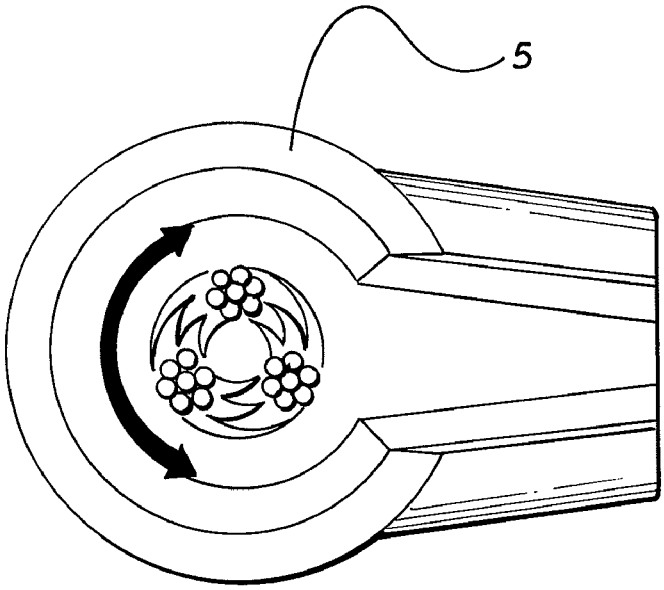
FIG. 3 is a top plan view of a plug adapter housing in an embodiment of the present invention.

Referring to FIGS. 1-3, a rotating plug adapter in an embodiment of the invention generally includes a housing with a top 5 and bottom 10, a rotatable receptacle 50 integral to an outer periphery of the housing, a rotary cap 15 and right spade 20, left spade 25 and grounding post 28 mounted in the cap. Rotatable contact elements and grooves within the housing provide rotatable electrical connections between the receptacle 50 and plug portion of the adapter that includes spades 20 and 25 and grounding post 28.

The housing comprises a coupled top 5 and bottom 10 of insulative material. Rotary cap 15, also of insulative material, is mounted in a cap opening 12 between housing top 5 and housing bottom 10. The cap 5 is mounted to freely rotate within the cap opening 12 and the surrounding housing of the adapter plug.

In an embodiment depicted in FIG. 1, the cap includes left spade slot 16, right spade slot 17 and ground post slot 18. Spades 20 and 25 and post 28 are respectively mounted in slots 16, 17 and 18. In other embodiments spades 20 and 20 and post 18 may be integrally mounted in cap 15, such as insert molded directly in the cap 15.

Figure 5:
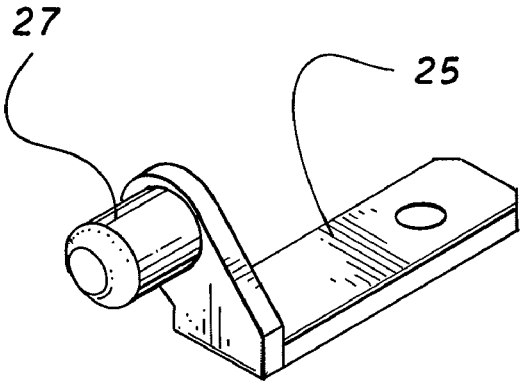
FIG. 5 is an perspective view of a left spade and left spade rotary contact in an embodiment of the present invention.
Figure 6:
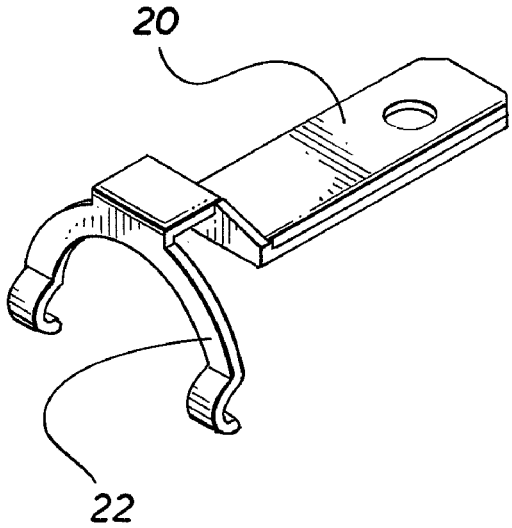
FIG. 6 is an perspective view of right spade and right spade rotary contact in an embodiment of the present invention.

With further reference to FIGS. 5 and 6, right spade 20 which is mounted in right spade slot 16, includes a rotary contact 22. In the described embodiment, rotary contact 22 is an annular segment contact portion with brushes integrally connected to the spade 20. Left spade 25, mounted in left opening 17, includes a rotary contact 27. In the described embodiment, rotary contact 27 is a post portion integrally connected to the spade 20.

Figure 7:
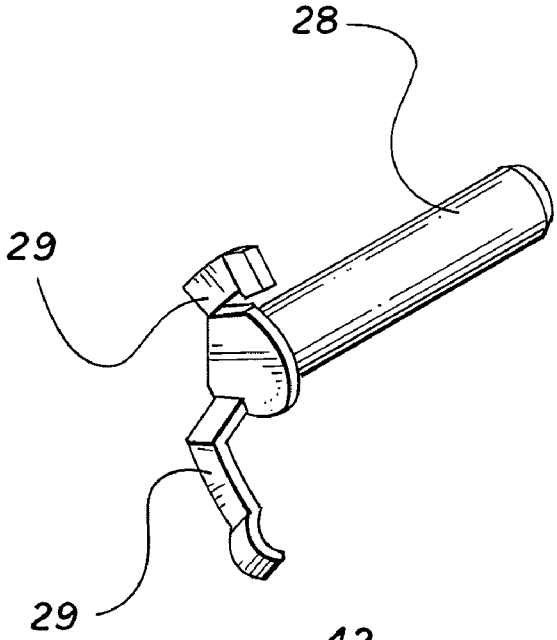
FIG. 7 an perspective view of a grounding post and grounding post rotary contact in an embodiment of the present invention.

Referring to FIG. 7, grounding post 28 is to be mounted in grounding slot 18. Grounding post 28 includes a rotary contact 29. The described embodiment grounding post rotary contact is a pair of projections integrally connected to grounding post 28.

Figure 4:
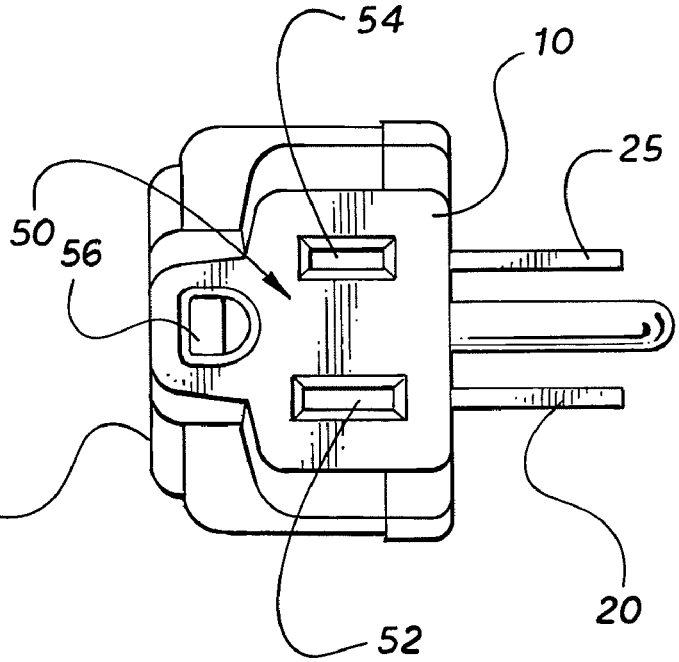
FIG. 4 is a side elevational view of plug adapter housing and integral receptacle in an embodiment of the present invention.

Referring to FIGS. 1, 2 and 4, housing top 5 includes a central annular flange 102 having a radial slot 101 formed therein and defining a central groove 100. A first concentric annular flange 107 having two radial slots 108 and 109 defines a first concentric annular groove 105. A second concentric annular flange 112 with complementary radial slots 118 and 119 defines a second concentric annular groove 110. Housing support gussets 114 are provided within annular grooves 105 and 110 to reinforce the concentric flanges and maintain desired positioning and separation of electrical contact elements.

An integral receptacle 50 includes left blade opening 54, right blade opening 52 and grounding post opening 56 which include respective grooves extending into the housing top 5. It will be appreciated that the flanges, gussets, slots and grooves are constructed to ensure proper electrical contacts and to avoid unwanted electrical contacts. It should also be appreciated that depicted grooves and flanges are exemplary, and flanges may define other groove shapes that permit rotary motion of the plug adapter while maintaining proper electrical contacts between a plug in receptacle 50 and spades 20 and 25 and grounding post 28 engaged in a wall receptacle.

Figure 8:
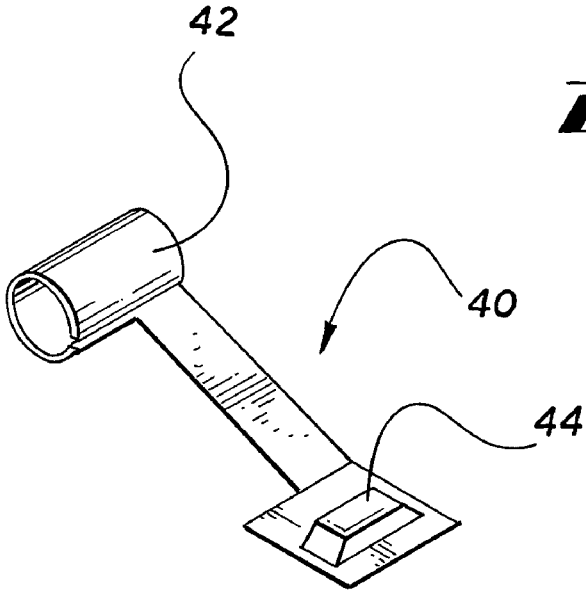
FIG. 8 is an perspective view of a left spade housing rotary contact in an embodiment of the present invention.
Figure 9:
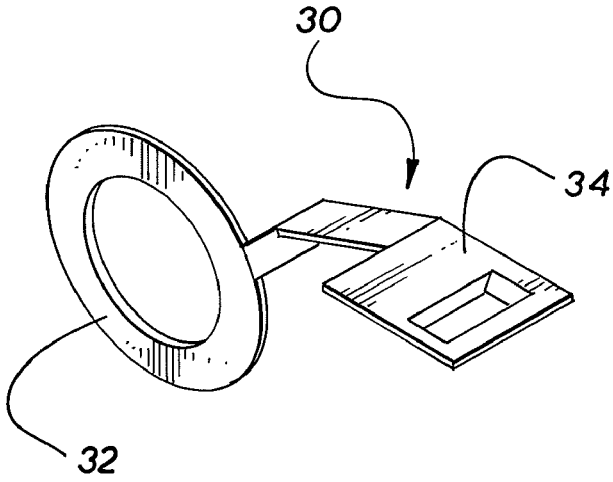
FIG. 9 is an perspective view of a right spade housing rotary contact in an embodiment of the present invention.

With continuing reference to FIGS. 1, 2 and 4, and further reference to FIG. 8, a left spade housing rotary contact 40 includes sleeve contact portion 42 and left plug blade contact portion 44. Left blade housing rotary contact 40 is mounted with sleeve contact portion 42 in central groove 100 and left plug blade contact portion 44 extending through slots 101, 108 and 118 formed in flanges 102, 107 and 112 into a groove terminating at left blade opening 54. Sleeve contact portion 42 rotatably abuts the post portion of rotary contact 27 of left spade 25 within central groove 100 providing electrical contact there between.

Figure 12:
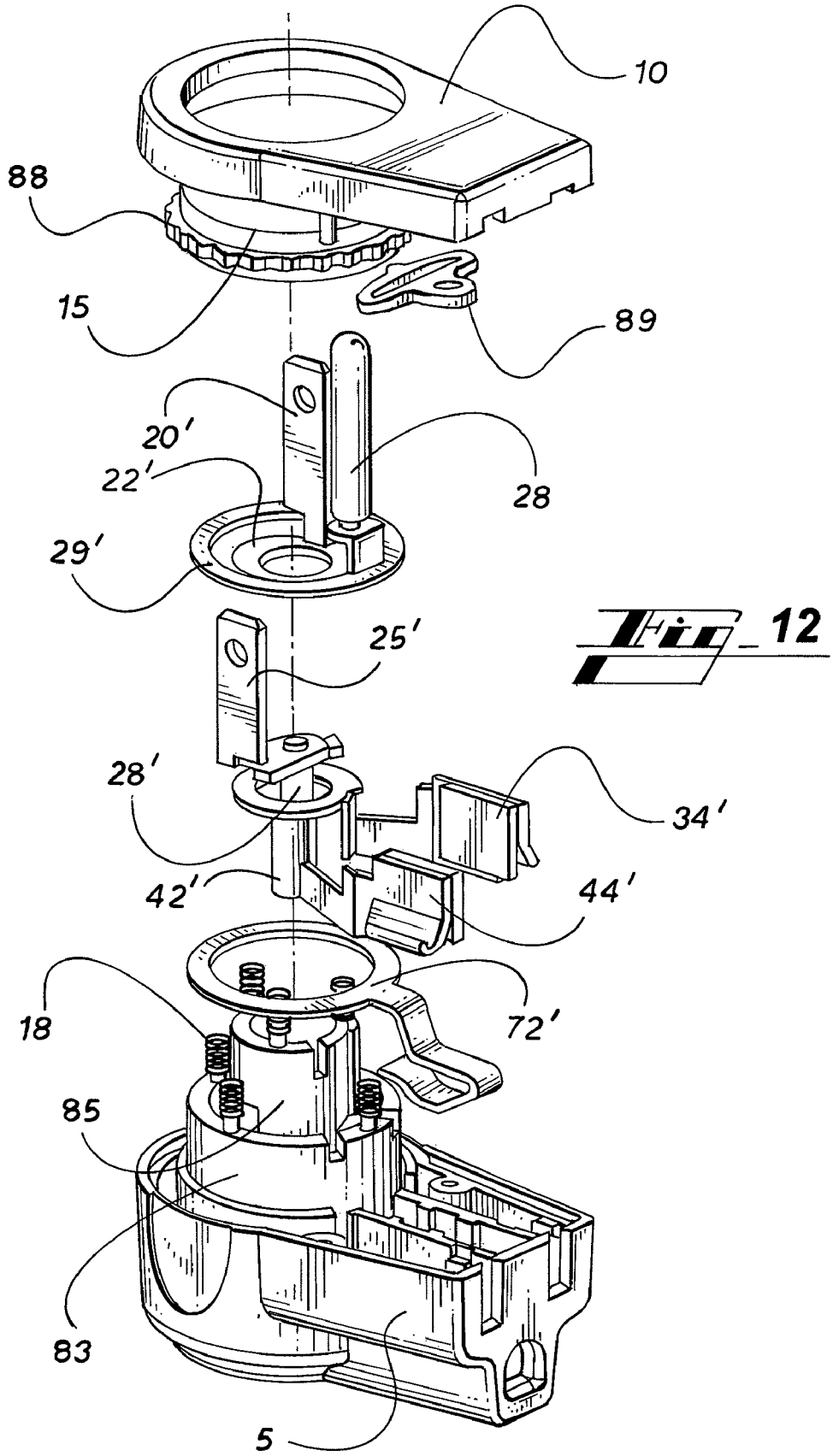
FIG. 12 is an exploded perspective view of a rotating plug adapter in a second embodiment of the invention.

With continuing reference to FIGS. 1, 2, 4, 9 and further reference to FIG. 12, a right spade housing rotary contact 30 includes annular contact portion 32 and right plug blade contact portion 34. Right blade housing rotary contact 30 is mounted with annular contact portion 32 in first concentric annular groove 107 and right plug blade contact portion 34 extending through slots 109 and 119 formed in flanges 107 and 112 into a groove terminating at right blade opening 52. Annular contact portion 32 slidably abuts the annular segment portion of rotary contact 22 of right spade 20 within groove 105 providing electrical contact there between.

Figure 10:
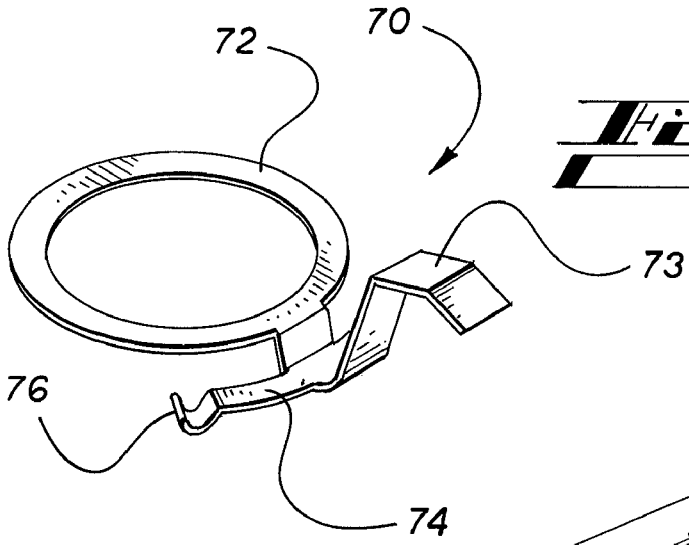
FIG. 10 is an perspective view of a housing grounding rotary contact in an embodiment of the present invention.

With continuing reference to FIGS. 1, 2 and 4, and further reference to FIG. 10, a housing grounding rotary contact 70 includes annular contact portion 22 and grounding post receptacle contact portion 73. Housing grounding rotary contact 70 is mounted with annular contact portion 72 in second concentric annular groove 110 and grounding post receptacle contact portion 73 in the groove of grounding post receptacle opening 56. Annular contact portion 72 slidably abuts the projections of rotary contact 29 of grounding post 28.

With continuing reference to FIG. 10, in other embodiments of the invention a rotary ratchet spring 74 is integral to housing grounding rotary contact 70 and mounted to avoid electrical contact with any contact portions between the top 5 and bottom 10 of the housing. Rotary ratchet spring 74 includes one or more ratchet wings 76 that engage ratchet teeth 65, such as a saw tooth pattern, provided around the perimeter of rotary cap 65. Spring loaded wings 76 engage teeth 65 as the housing is rotated about the rotary cap 15 with spades 20 and 25 and grounding post 28 in a wall receptacle. Rotary ratchet spring 74 enables the receptacle 50 to remain firmly oriented once the housing and receptacle 50 are rotated to a desired position.

In an alternate embodiment shown in FIG. 12, wherein like elements to those described above are denoted by a prime adjacent the reference numeral, housing grounding rotary contact 70' includes annular contact portion 72' and grounding post receptacle contact portion 73'. A plurality of compression springs 81 are mounted on posts on internal insulative rings 83 and 85 placed in grooves 105 and 110 and abut annular contact portions 32' and 72' to insure cooperative engagement with their respective rotary contacts 22' and 29'. Further, a toothed ring 88 formed on cap 5' cooperates with pawl 89 affixed to top 10 to maintain the plug in a selected position as in the previously discussed embodiment.

Figure 11:
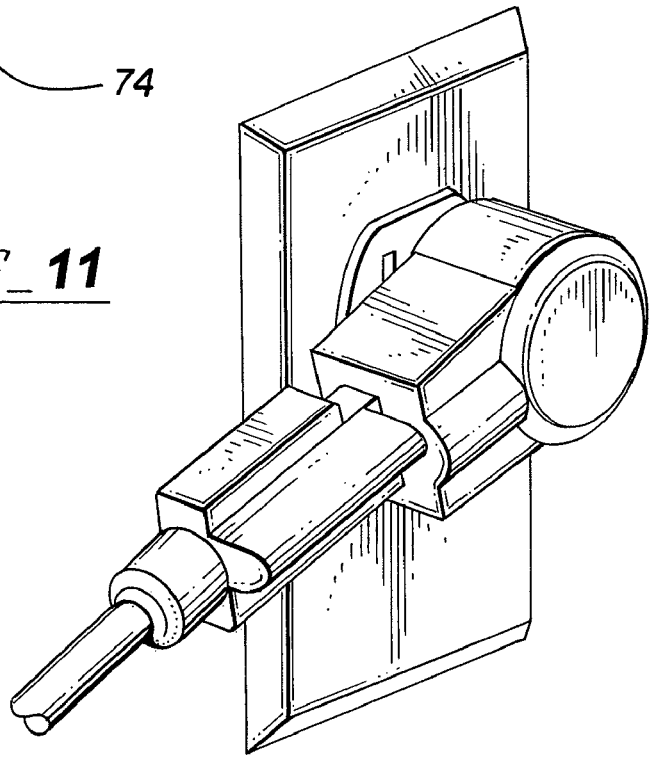
FIG. 11 is a perspective view of a rotating plug adapter engaged in a receptacle in an embodiment of the present invention.

Referring to FIGS. 3, 4 and 11, embodiments of the invention are shown for a plug adapter in which an integral plug receptacle 50 on the periphery of the adapter housing is rotatable through a rotation of 360 degrees. Rotary cap 15 with spades 20 and 25 and grounding post 28 engaged in a wall receptacle remains in fixed position, as the housing formed of the coupling of housing top 5 and housing bottom 10 are free to rotate about the unfixed rotary cap 15 and spades 20 and 25 and grounding post 28. Receptacle 50 which engages a two blade and grounding post plug, such as from an electric appliance, is rotated to a desired position.

Although the invention herein has been described with reference to particular embodiments, it is to be understood that these embodiments are merely illustrative of the principals and applications of the present invention. Accordingly, while the invention has been described with reference to the structures and processes disclosed, it is not confined to the details set forth, but is intended to cover such modifications or changes as may fall within the scope of the following claims.

What is claimed is:

1. An electrical plug adapter comprising:

a housing including a top, bottom and outer periphery;

a cap rotatably mounted between the top and bottom of the housing;

a first spade mounted in the cap, wherein the first spade includes a first spade rotary contact rotatably abutting a first housing rotary contact;

a second spade mounted in the cap, wherein the second spade includes a second spade rotary contact slidably abutting a second housing rotary contact;

a grounding post mounted in the cap, wherein the grounding post includes a grounding rotary contact slidably abutting a housing grounding rotary contact;

a plug receptacle integral to the outer periphery of the housing and rotatable around the rotary cap, wherein the plug receptacle includes a first receptacle opening including a portion of the first housing rotary contact mounted therein;

a second receptacle opening including a portion of the second housing rotary contact mounted therein; and a grounding post receptacle opening including a portion of the housing grounding rotary contact mounted therein.

2. The adapter of claim 1 further comprising a rotary ratchet spring mounted between the top and bottom of the housing.

3. The adapter of claim 2 wherein the rotary cap includes a plurality of teeth and the ratchet spring includes one or more wings rotatable between a pair of teeth to lock the ratchet and housing with the plug receptacle facing a desired position.

4. The adapter of claim 3 further comprising:

a sleeve of the first spade rotary contact covering a post of a first housing rotary contact; and the second spade rotary contact and second housing rotary contact each include a slip ring.

5. The adapter of claim 4 wherein the portion of the first housing rotary contact mounted in the first receptacle opening includes a flat contact for abutting a flat blade of a plug and the portion of the first housing rotary contact mounted in the first receptacle opening includes a flat contact for abutting a flat blade of a plug.

6. The adapter of claim 1 further comprising:

a sleeve of the first spade rotary contact covering a post of a first housing rotary contact; and the second spade rotary contact and second housing rotary contact each include a slip ring.

7. The adapter of claim 6 wherein the portion of the first housing rotary contact mounted in the first receptacle opening includes a flat contact for abutting a flat blade of a plug and the portion of the first housing rotary contact mounted in the first receptacle opening includes a flat contact for abutting a flat blade of a plug.

8. The adapter of claim 7 further comprising one or more springs mounted between the top and bottom of the housing to maintain contact between the second spade rotary contact and second housing rotary contact.

9. The adapter of claim 1 further comprising one or more springs mounted between the top and bottom of the housing to maintain contact between the second spade rotary contact and second housing rotary contact.

10. The adapter of claim 3 further comprising one or more springs mounted between the top and bottom of the housing to maintain contact between the second spade rotary contact and second housing rotary contact.

11. The adapter of claim 5 further comprising one or more springs mounted between the top and bottom of the housing to maintain contact between the second spade rotary contact and second housing rotary contact.

12. The adapter of claim 11 wherein the rotary ratchet spring is integral to the housing grounding rotary contact.

13. The adapter of claim 1 wherein the rotary ratchet spring is integral to the housing grounding rotary contact.

14. The adapter of claim 3 wherein the rotary ratchet spring is integral to the housing grounding rotary contact.

15. The adapter of claim 5 wherein the rotary ratchet spring is integral to the housing grounding rotary contact.

16. The adapter of claim 1 wherein the top of the housing is flat and low profile.

17. The adapter of claim 2 wherein the top of the housing is flat and low profile.

18. The adapter of claim 3 wherein the top of the housing is flat and low profile.

19. The adapter of claim 4 wherein the top of the housing is flat and low profile.

20. The adapter of claim 5 wherein the top of the housing is flat and low profile.

* * * * *